US008386242B2

(12) United States Patent
Kim et al.

(10) Patent No.: US 8,386,242 B2
(45) Date of Patent: Feb. 26, 2013

(54) METHOD, MEDIUM AND APPARATUS ENHANCING A BASS SIGNAL USING AN AUDITORY PROPERTY

(75) Inventors: Jung-ho Kim, Yongin-si (KR); Sang-wook Kim, Seoul (KR); Young-tae Kim, Seongnam-si (KR); Sang-chul Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 570 days.

(21) Appl. No.: 11/812,950

(22) Filed: Jun. 22, 2007

(65) Prior Publication Data

US 2008/0091416 A1 Apr. 17, 2008

(30) Foreign Application Priority Data

Oct. 17, 2006 (KR) ..... 10-2006-0101042

(51) Int. Cl.
*G10L 19/00* (2006.01)

(52) U.S. Cl. ..... 704/200.1; 704/209; 704/206; 704/226

(58) Field of Classification Search ..... 704/223, 704/226, 200, 204, 205, 200.1, 206, 209, 704/203, 207; 381/98
See application file for complete search history.

(56) References Cited

U.S. PATENT DOCUMENTS

| | | | | |
|---|---|---|---|---|
| 5,651,092 | A * | 7/1997 | Ishii et al. | 704/226 |
| 5,668,885 | A * | 9/1997 | Oda | 381/98 |
| 5,930,373 | A | 7/1999 | Shashoua et al. | |
| 6,067,511 | A * | 5/2000 | Grabb et al. | 704/223 |
| 6,285,767 | B1 | 9/2001 | Klayman | |
| 2006/0159283 | A1 | 7/2006 | Mathew et al. | |

FOREIGN PATENT DOCUMENTS

| | | |
|---|---|---|
| KR | 10-2006-0083318 | 7/2006 |
| WO | 00/14998 | 3/2000 |
| WO | 2005/055645 | 6/2005 |

OTHER PUBLICATIONS

Korean Notice of Allowance mailed Mar. 28, 2008 issued in corresponding Korean Patent Application No. 10-2006-0101042.
Steve Temme, "Audio Distortion Measurements", Brüel & Kjær Application Note, 1992, pp. 1-20.

* cited by examiner

*Primary Examiner* — Huyen X. Vo
(74) *Attorney, Agent, or Firm* — Staas & Halsey LLP

(57) ABSTRACT

Provided are a method, medium and apparatus for enhancing an acoustic signal using an auditory property. An acoustic signal is enhanced by generating a plurality of harmonic signals based on a predetermined acoustic signal frequency, selecting harmonic signals, which exist in an area masked by the predetermined harmonic signal, from among the generated plurality of harmonic signals, and outputting harmonic signals remaining after excluding the selected harmonic signals from the generated plurality of harmonic signals. The enhancement results in a bass signal of good sound quality and having a low distortion ratio, without changing the structure of a micro speaker.

22 Claims, 7 Drawing Sheets

METHOD, MEDIUM AND APPARATUS ENHANCING A BASS SIGNAL USING AN AUDITORY PROPERTY

CROSS-REFERENCE TO RELATED APPLICATIONS

This application claims the benefit of Korean Patent Application No. 10-2006-0101042, filed on Oct. 17, 2006, in the Korean Intellectual Property Office, the disclosure of which is incorporated herein in its entirety by reference.

BACKGROUND

1. Field

One or more embodiments of the present invention relate to an enhancement of an acoustic signal, and more particularly, to a method, medium and apparatus for enhancing a bass signal using psychoacoustics and a masking effect.

2. Description of the Related Art

Speakers are electromechanical-acoustic devices that convert an electrical signal from an amplifier into sound. The audible sound is created by generating longitudinal waves in the air using a vibrating diaphragm, typically called a driver, or speaker driver. Speakers only reproduce a signal within a predetermined frequency range due to the structural characteristics of the speakers. That is, speakers can only reproduce a signal corresponding to a fixed frequency reproduction band from an electrical signal without distortions. The minimum reproduction frequency corresponding to the frequency reproduction band means the lowest frequency at which sound can be reproduced without distortion.

Thus, in order to reproduce a low frequency, or bass signal, speakers must be designed so that the minimum reproduction frequency is low, and in order to lower the minimum reproduction frequency of speakers, speakers must have a large-diameter driver and a relatively large cabinet volume to assure a sufficient vibrating depth.

However, due to a trend towards light, thin, and miniaturized electronic products, the size of speakers for generating sound from various acoustic products has gradually been miniaturized, and available space for speaker installation has also been reduced. Thus, for micro speakers used in mobile phones, portable multimedia devices, and headphones, speakers are only available whose maximum bass reproduction is in the hundreds of Hz, due to the limitation in the size of the micro speakers. However, since the human-audible band is conventionally 20 Hz to 20,000 Hz, a non-reproducible audible band exists for typical micro speakers corresponding to 20 Hz to hundreds of Hz, or the bass reproduction limit of the speakers. The structural limitations of these micro speakers cause the listener to hear only a relatively plain sound in which a deep, rich bass signal is not included.

In order to improve this problem of micro speakers, a technique of representing a bass signal using psychoacoustics has been developed. Psychoacoustics deals with the kind of psychological effects that sounds in different time, space, and frequency induce on a human. Psychoacoustics will now be described in detail.

FIG. 1 is a graph for describing a psychoacoustic bass perception effect using harmonics.

The phenomenon of representing bass signals using harmonics is called a virtual pitch or a missing fundamental frequency in psychoacoustics as described below. In FIG. 1, since a signal having a frequency f has a lower frequency than the minimum reproduction frequency of the speaker, the speaker does not reproduce the signal. The minimum reproduction frequency of the speaker denotes the lowest frequency at which sound can be reproduced by the speaker without distortion within the frequency reproduction band, i.e., a frequency corresponding to a point of which a slope is '0' in the graph illustrated in FIG. 1. Since the speaker does not reproduce the signal having the frequency f, an audience cannot perceive the signal having the frequency f. However, if a sound generated by properly attenuating the harmonics, such as 2f, 3f, 4f, 5f, . . . , nf which are generated using the frequency f as a fundamental frequency, is provided to the audience, the audience can perceive the signal having the fundamental frequency f from the harmonics having n times the fundamental frequency f (n is a positive integer equal to or greater than 2). This phenomenon is called a virtual pitch or a missing fundamental frequency.

A psychoacoustic technique of representing bass signals using harmonics has been used for musical instruments, such as pipe organs, for many years. In addition, a technique of hearing bass signals using the psychoacoustic method is disclosed in an issued US patent. However, in the issued US patent, since only a portion, from which bass signals are perceived, is analogized from conventional acoustics and implemented using only an electrical circuit or algorithm, the sound quality, which is an important element of sound reproduction, is relatively poor.

The reason sound quality is relatively poor in the conventional psychoacoustic technique as described above will be described herein in detail.

FIG. 2 is a graph illustrating a frequency response curve and a Total Harmonic Distortion (THD) curve measured from a micro speaker.

THD denotes a ratio of harmonic components to a fundamental frequency and the harmonic components and is represented by Equation 1.

$$THD=\text{TotalDistortion/Total}=\sqrt{a_2^2+a_3^2+a_4^2+\ldots+a_n^2}/\sqrt{a_1^2+a_2^2+a_3^2+a_4^2\ldots+a_n^2} \quad \text{Equation 1}$$

Here, $a_1$, denotes an amplitude of the fundamental frequency, $a_2$ denotes an amplitude of a second harmonic, $a_3$ denotes an amplitude of a third harmonic, and $a_n$ denotes an amplitude of an $n^{th}$ harmonic.

If the THD is high, it may mean that a relatively large proportion of noise is mixed in with the audio, and thus sound quality is poor. That is, it can be seen using Equation 1 that the greater the number of harmonic components, the poorer the sound quality.

As illustrated in FIG. 2, a THD value varies according to frequency. Hence, the THD value is generally very low in the frequency reproduction band, however, the THD value is relatively high in a specific band (e.g., the A band of FIG. 2) of the frequency reproduction band and thus, sound quality is relatively poor in the conventional psychoacoustic method. Also, since a method of enhancing a bass signal using psychoacoustics allows a human being to perceive a signal having the fundamental frequency using the harmonic components, many harmonic components generated by setting a sound to be heard as the fundamental frequency exist. That is, in the conventional method of enhancing a bass signal using psychoacoustics, the sound quality is poor since a relatively high THD value is inevitable.

SUMMARY

One or more embodiments of the present invention provide a method, medium and apparatus for hearing a bass signal whose sound quality is improved without a structural change of a speaker when the bass signal is reproduced by the speaker.

One or more embodiments of the present invention also provide a method, medium and apparatus for hearing a bass signal having sound quality conforming to that desired by a user, without a structural change of a speaker, by adjusting a Total Harmonic Distortion (THD) value to be less than a predetermined value.

One or more embodiments of the present invention also provide a computer readable recording medium storing a computer readable program for executing the method.

Additional aspects and/or advantages of the invention will be set forth in part in the description which follows and, in part, will be apparent from the description, or may be learned by practice of the invention.

To achieve at least the above and/or other aspects and advantages, embodiments of the present invention include a method of enhancing an acoustic signal. The method includes generating a plurality of harmonic signals based on a predetermined audio signal, selecting harmonic signals that exist in an area masked by a predetermined harmonic signal, from among the generated plurality of harmonic signals, and outputting harmonic signals remaining after excluding the selected harmonic signals from the generated plurality of harmonic signals.

To achieve at least the above and/or other aspects and advantages, embodiments of the present invention include a method of enhancing an acoustic signal. The method includes generating a plurality of harmonic signals based on a predetermined audio signal, selecting harmonic signals that do not exist in an area masked by a predetermined harmonic signal, from among the generated plurality of harmonic signals, upon a Total Harmonic Distortion (THD) value, calculated while increasing an order of the selected harmonic signals, exceeding a predetermined THD value, determining a minimum order of harmonic signals, whose THD value exceeds the predetermined THD value, as a limited harmonic order, and outputting harmonic signals whose order is lower than the determined limited harmonic order from among the selected harmonic signals.

To achieve at least the above and/or other aspects and advantages, embodiments of the present invention include an apparatus for enhancing a bass signal using an auditory property. The apparatus includes a harmonic generator to generate a plurality of harmonic signals based on a predetermined audio signal, a harmonic selector to select harmonic signals that are not masked by a predetermined harmonic signal, from among the generated plurality of harmonic signals, and an output unit to output harmonic signals selected by the harmonic selector.

To achieve at least the above and/or other aspects and advantages, embodiments of the present invention include an apparatus for enhancing an acoustic signal. The apparatus includes a harmonic generator to generate a plurality of harmonic signals based on a predetermined audio signal, a harmonic selector to select harmonic signals masked by a predetermined harmonic signal, from among the generated plurality of harmonic signals, and an amplitude adjuster to adjust amplitudes of harmonic signals selected by the harmonic selector to "0."

To achieve at least the above and/or other aspects and advantages, embodiments of the present invention include a method of representing an audio signal using a plurality of harmonics generated from the audio signal. The method includes generating a masking curve based on a harmonic of the audio signal, and selecting only unmasked harmonics, based on the generated masking curve, to represent the audio signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
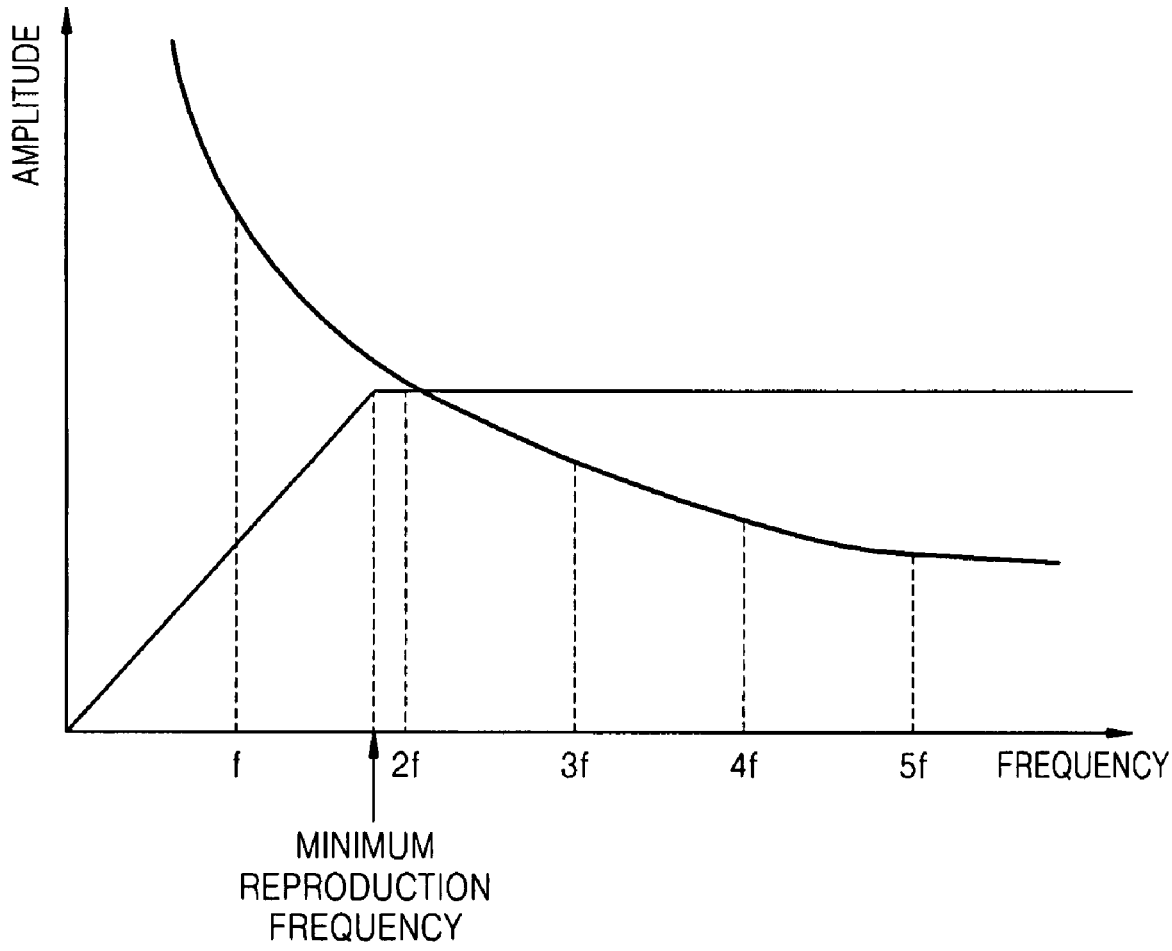
FIG. 1 (RELATED ART)
FIG. 1 is a graph describing a psychoacoustic bass perception effect using harmonics.
Figure 2:
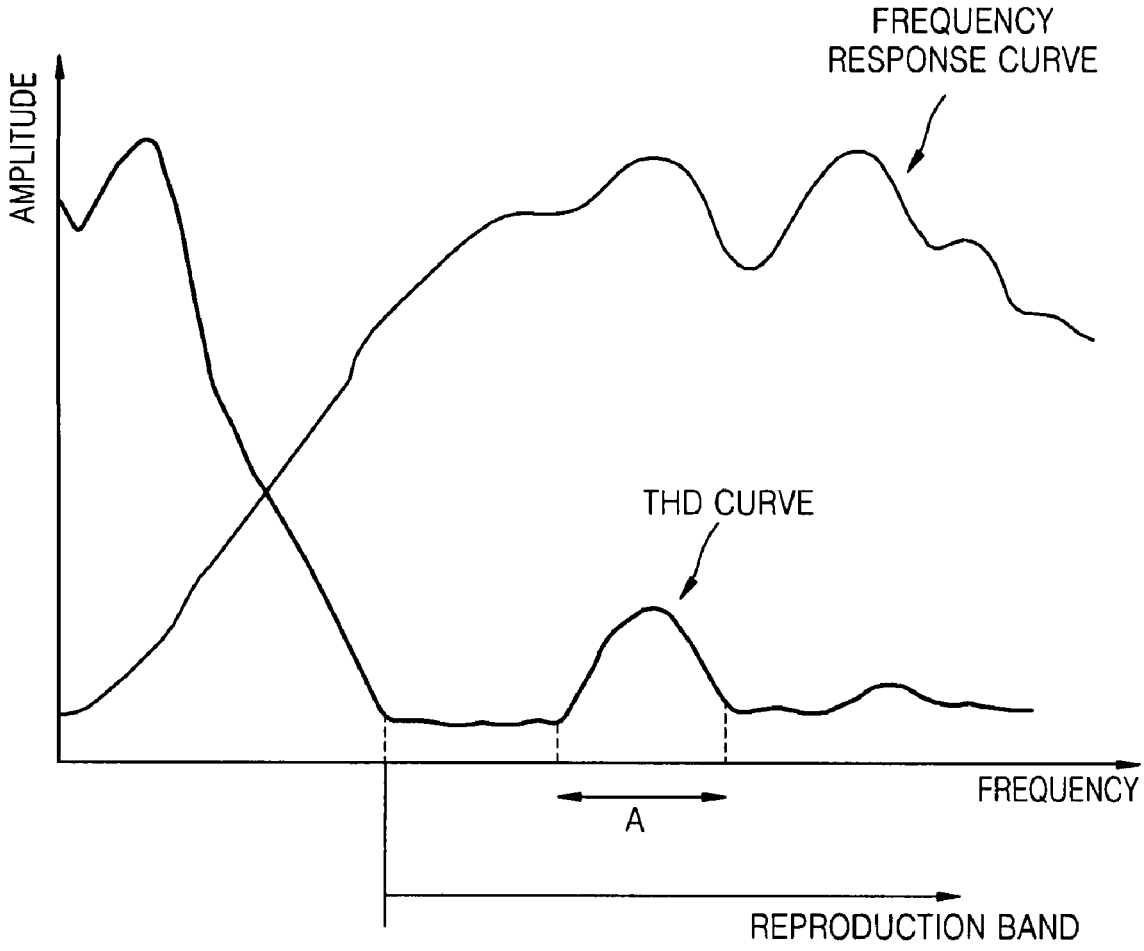
FIG. 2 (RELATED ART)
FIG. 2 is a graph showing a frequency response curve and a Total Harmonic Distortion (THD) curve measured from a micro speaker.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 3:
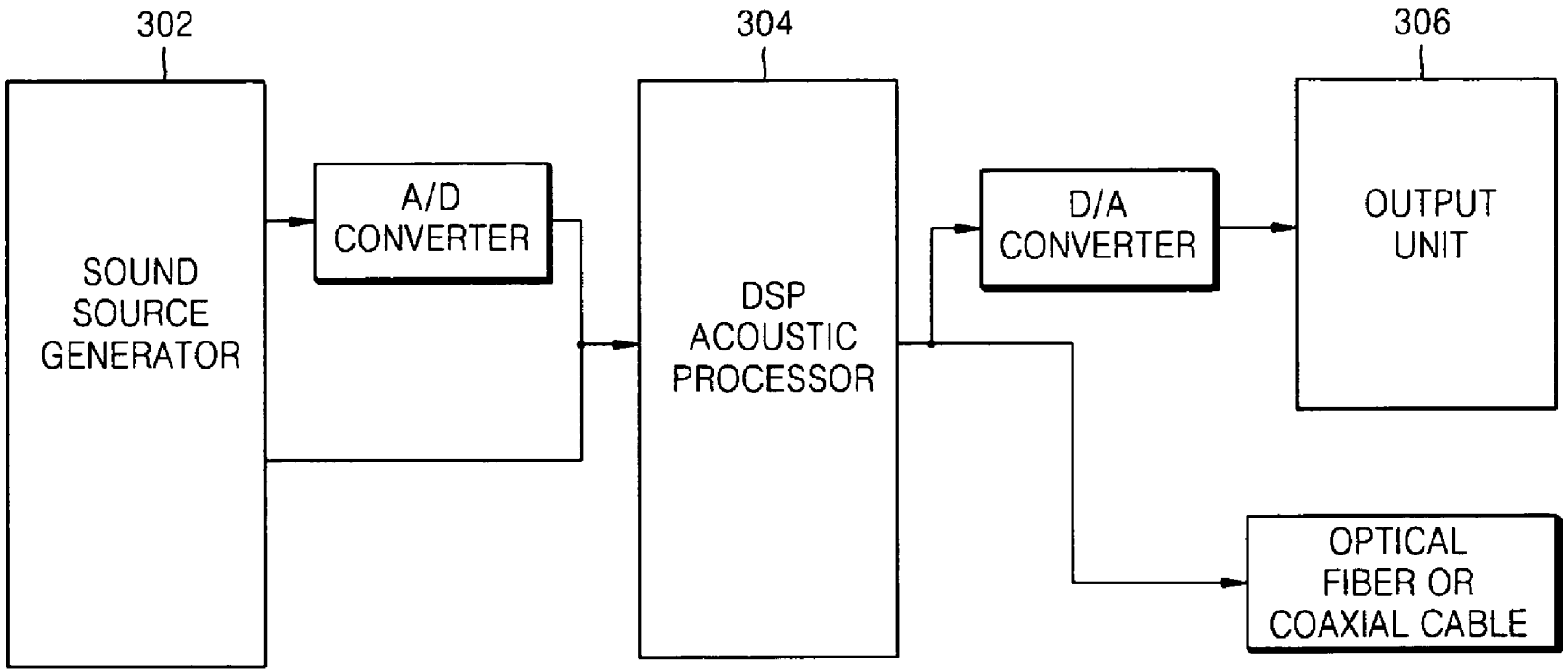
FIG. 3 illustrates an acoustic signal transferring process performing an acoustic signal enhancement method, according to an embodiment of the present invention.

FIG. 3 illustrates an acoustic signal transferring process for performing an acoustic signal enhancement method, according to an embodiment of the present invention.

A transfer path of an acoustic signal in a conventional device having a Digital Signal Processor (DSP) is typically through a sound source generator 302, a DSP acoustic processor 304, and an output unit 306. That is, the sound source generator 302 may generate an analog or digital acoustic signal, the DSP acoustic processor 304 may process the generated acoustic signal, and the output unit 306, such as a speaker or headphones, may output the processed acoustic signal. Since a bass signal enhancement method according to an embodiment of the present invention may process a signal using the DSP acoustic processor 304, the bass signal enhancement method may be performed by one of several modules of the DSP acoustic processor 304, for example. In such case, since the generated acoustic signal can be input to each of the modules of the DSP acoustic processor 304 in parallel or serially, a signal flow need not specifically be limited thereto. That is, a module of the DSP acoustic processor 304 may perform the bass signal enhancement method, according to an embodiment of the present invention before the signal is input to the output unit 306, for example.

Figure 4:
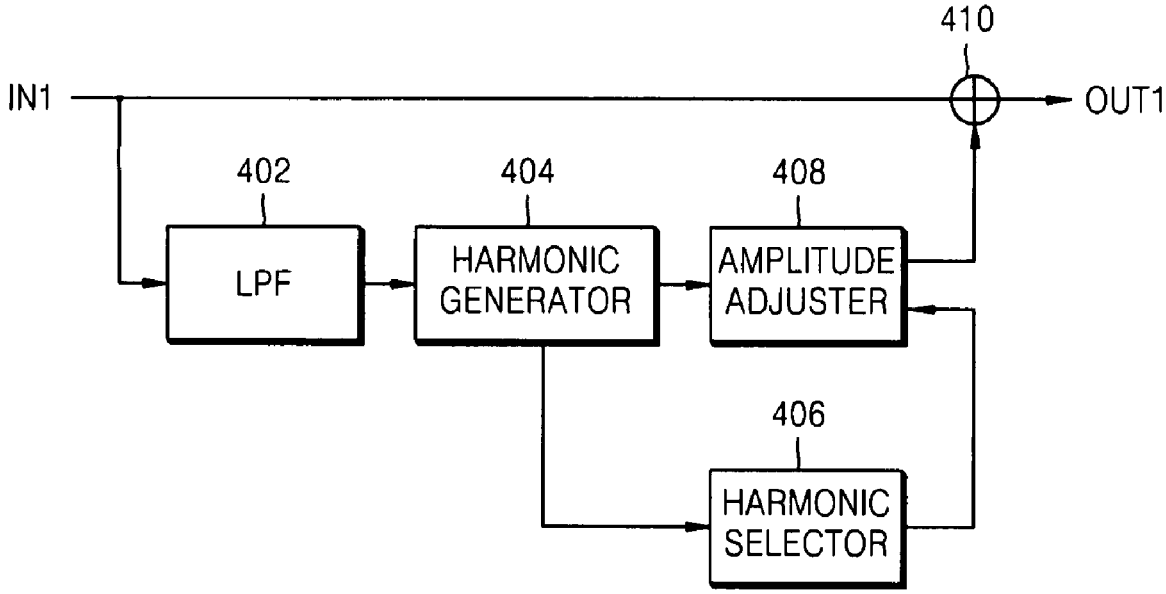
FIG. 4 is illustrates an apparatus for enhancing an acoustic signal using an auditory property, according to an embodiment of the present invention.

FIG. 4 illustrates an apparatus enhancing an acoustic signal using an auditory property, according to an embodiment of the present invention.

As described above, the apparatus, such as illustrated in FIG. 4 may be used as a single module of the DSP acoustic processor 304, such as illustrated in FIG. 3.

Referring to FIG. 4, the apparatus enhancing an acoustic signal using an auditory property may include, for example, a low pass filter (LPF) 402, a harmonic generator 404, a harmonic selector 406, an amplitude adjuster 408, and a synthesizer 410.

The LPF 402 may filter a bass signal for bass enhancement from a signal input through an input terminal IN1, for example. A cutoff frequency of the LPF 402 may be the minimum reproduction frequency of a speaker (not shown). Here, the LPF 402 may filter a bass signal having a frequency lower than the minimum reproduction frequency of the speaker, for example. Since the filtered bass signal may be a signal having a frequency lower than the minimum reproduction frequency of the speaker, the speaker cannot reproduce the filtered bass signal.

The harmonic generator 404 may generate a plurality of harmonic signals whose fundamental frequency is the frequency of the bass signal filtered by the LPF 402. That is, the harmonic generator 404 may generate a plurality of harmonic signals by setting the frequency of the bass signal filtered by the LPF 402 as the fundamental frequency, and modulating the amplitudes of the high-order harmonics having n times the fundamental frequency (where n is a positive integer equal to or greater than 2) so that the high-order harmonics are attenuated. The generated harmonic signals may have an even order, an odd order, or a total order of the fundamental frequency, although the present embodiment is not limited thereto. When the LPF 402 is set to have a cutoff frequency equal to the minimum reproduction frequency of the speaker and filters the bass signal having a frequency lower than the minimum reproduction frequency, the harmonic generator 404 may generate harmonic signals that exceed the minimum reproduction frequency of the speaker. Since the harmonic signals generated by the harmonic generator 404 may exceed the minimum reproduction frequency of the speaker, the speaker may reproduce the harmonic signals generated by the harmonic generator 404. In addition, the amplitudes of the generated harmonic signals may be modulated so that the generated harmonic signals are attenuated according to an increase of the harmonic order. Various techniques, such as an exponential attenuation technique and an auditory sensation weighting attenuation technique, may be used for the amplitude modulation of the generated harmonic signals, although the applied attenuation methods are not limited thereto. The harmonic signals generated by the harmonic generator 404 may be input to the harmonic selector 406 and the amplitude adjuster 408, for example.

The harmonic selector 406 may select harmonic signals to represent the bass signal having the fundamental frequency, from among the input harmonic signals of the harmonic generator 404 using a human auditory property.

Figure 5:
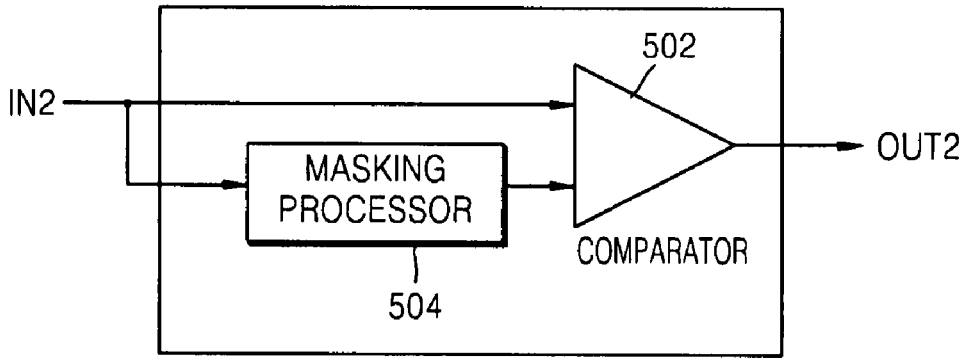
FIG. 5 illustrates a harmonic selector, such as of the apparatus for enhancing an acoustic signal illustrated in FIG. 4, according to an embodiment of the present invention.

FIG. 5 illustrates a harmonic selector 406, such as of the apparatus for enhancing an acoustic signal using an auditory property illustrated in FIG. 4, according to an embodiment of the present invention.

A process of selecting harmonic signals that are to be used to perceive the bass signal having the fundamental frequency will now be described with reference to FIG. 5.

The harmonic selector 406 may select signals existing in a masked area of a harmonic signal having the greatest amplitude, from among the harmonic signals input, e.g., by the harmonic generator 404. Here, the signals having the greatest amplitude existing in the masked area of the harmonic signal may be selected using a masking effect. The masking effect generally refers to a human auditory property where a single sound affects sounds of surrounding frequency components. That is, the masking effect is a phenomenon where the minimum audible value of an audio signal may increase due to interference from a masked sound, and where a certain sound may reduce a listener's ability to hear another sound having a slightly different frequency. For example, the masking effect may refer to a phenomenon where it is difficult to hear a signal 1 due to the existence of a signal 2, and as such, signal 1 is masked by signal 2.

Figure 6:
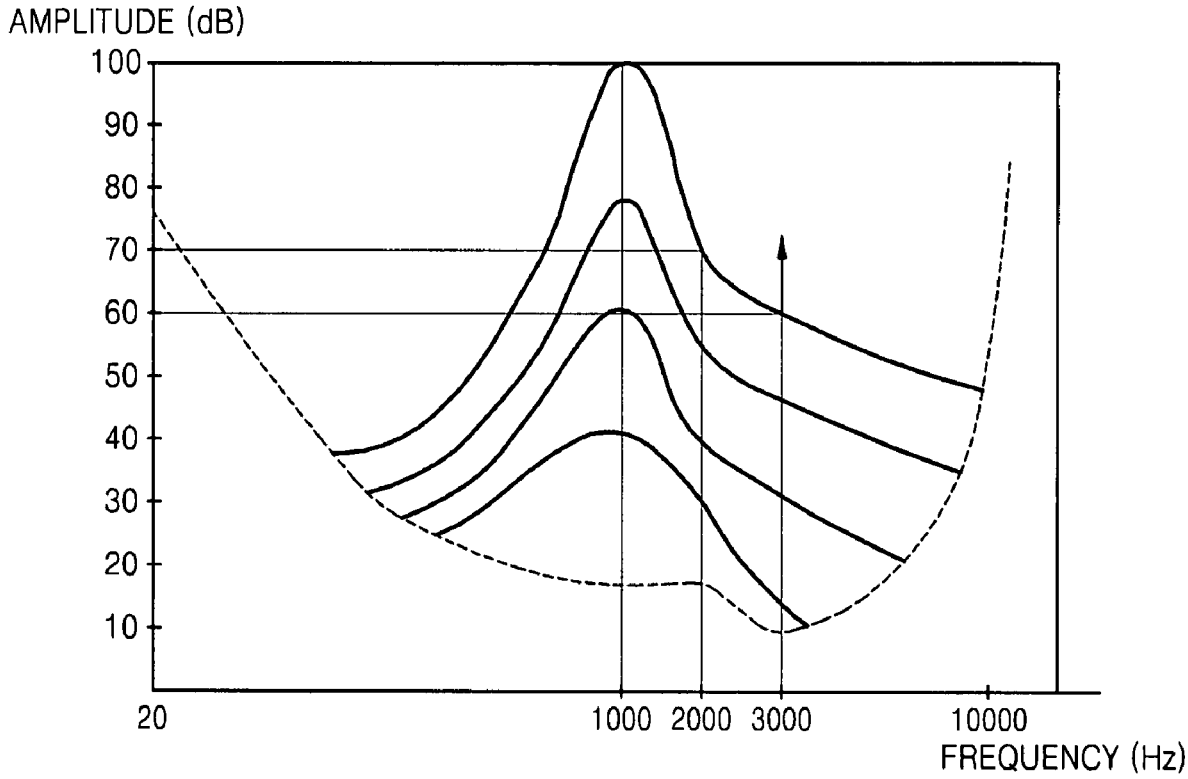
FIG. 6 is a masking curve graph used to select harmonic signals, which exist in a masked area, in a harmonic selector such as of the apparatus for enhancing an acoustic signal illustrated in FIG. 4, according to an embodiment of the present invention.

FIG. 6 is a masking curve graph that may be used in the harmonic selector 406 of the apparatus illustrated in FIG. 4 to select harmonic signals existing in a masked area of the harmonic signal having the greatest amplitude, according to an embodiment of the present invention. The harmonic signals existing in the masked area may be selected from among the input harmonic signals of the harmonic generator 404, according to an embodiment of the present invention.

FIG. 6 shows a masking curve developed by Zwicker in 1975 and shows that when a signal of a small width, which has a center frequency of 1 KHz, has an amplitude of 100 dB, a second harmonic having a center frequency of 2 KHz is masked below 70 dB and a third harmonic having a center frequency of 3 KHz is masked below 60 dB. That is, if the amplitude of the second harmonic is less than 70 dB, the second harmonic exists in a masked area of the first harmonic, and likewise, if the amplitude of the third harmonic is less than 60 dB, the third harmonic exists in the masked area of the first harmonic. If both the second and third harmonics exist in the masked area of the first harmonic, the second and third harmonic signals cannot be perceived by an auditory sense. The harmonic selector 406, according to an embodiment of the present invention may select harmonic signals, which cannot be perceived by the auditory sense, using the masking effect. Alternatively, the harmonic selector 406, according to an embodiment of the present invention may select harmonic signals of the harmonic generator 404, which may be perceived by the auditory sense, using the masking effect.

According to an embodiment of the present invention, since the amplitudes of the harmonic signals generated by the harmonic generator 404 may be attenuated as the harmonic order increases, the second harmonic generally has the greatest amplitude from among the harmonic signals generated by the harmonic generator 404. That is, if a second harmonic having a center frequency of 1 KHz has an amplitude of 100 dB, a third harmonic may be masked at less than 70 dB due to the second harmonic, and a fourth harmonic may be masked at less than 60 dB due to the second harmonic.

As described above, the harmonic selector 406, according to an embodiment of the present invention, may use the masking curve illustrated in FIG. 6 to select the harmonic signals used to represent the fundamental frequency, from among the harmonic signals generated by the harmonic generator 404. If the number of harmonic components is a large, a THD value increases, and thus sound quality may be poor as demonstrated in Equation 1. That is, the THD value may increase proportionally to the number of higher-order harmonics in Equation 1. Thus, the number of harmonic components to be used to represent the fundamental frequency should be decreased, and the masking curve may be used as the determination factor. Since the harmonic signals that are masked due to the second harmonic signal having the greatest amplitude cannot be perceived by the auditory sense, the masked harmonic signals do not significantly affect the perception of the fundamental frequency. Thus, if the fundamental frequency is perceived using only harmonic signals perceived by the auditory sense, distortion is low, and thus the fundamental frequency may be perceived by the auditory sense with improved sound quality resulting from the lower THD.

Referring back to FIG. 5, the harmonic selector 406, according to an embodiment of the present invention may include, for example, a comparator 502 and a masking processor 504.

The harmonic signals output from the harmonic generator 404 may be input to the comparator 502 via an input terminal IN2. The comparator 502 may select harmonics existing in a masked area of the second harmonic by comparing the amplitude of each of the input harmonics to a value of a masking curve generated based on the second harmonic signal. The harmonic signals existing in the masked area cannot be perceived by an auditory sense due to the described masking effect.

The masking processor 504 may receive the harmonic signals generated by the harmonic generator 404 via the input terminal IN2 and may store a masking curve value per frequency, generated based on the input second harmonic signal, in, for example, a look-up table (LUT). Although the masking curve values may be stored in the LUT according to an embodiment of the present invention, the present invention is not limited to thereto. For example, the masking curve processor 504 may use a method of calculating a masking curve value per frequency and extracting the calculated masking curve value per frequency.

The comparator 502 may receive the masking curve values per frequency stored in the masking processor 504 and compare the amplitude of each of the input harmonic signals to a corresponding masking curve value. That is, the comparator 502 may compare the amplitude, for example, of each of the third-order, the fourth-order, . . . , nth order harmonic signals to the masking curve value corresponding to the frequency of each of the harmonic signals. As a comparison result, if the amplitude of a harmonic signal is less than a corresponding masking curve value, the harmonic signal may be selected as a harmonic signal existing in the masked area of the second harmonic signal, e.g., due to the masking effect caused by the second harmonic signal. Accordingly, the selected harmonic signal may not be perceived by the auditory sense. However, if the amplitude of a harmonic signal is greater than a corresponding masking curve value, the harmonic signal may be selected as a harmonic signal not existing in the masked area of the second harmonic signal. The harmonic signal selected as not existing in the masked area may be perceived by the auditory sense.

The comparator 502 may generate a control signal for controlling the amplitude adjuster using the selection result and may output the generated control signal via an output terminal OUT2. That is, the comparator 502 may generate a control signal corresponding to the harmonic signal selected as a signal existing in the masked area and output the generated control signal via the output terminal OUT2. Even if a signal existing in the masked area is selected and a control signal is generated based on the selection result, according to an embodiment of the present invention, a signal not existing in the masked area may be selected and a control signal may be generated based on the selection result.

Referring back to FIG. 4, the amplitude adjuster 408 may receive a control signal indicating the existence of each of the harmonic signals in the masked area, from the harmonic selector 406, and may adjust the amplitude of each of the harmonic signals existing in the masked area, from among the harmonic signals generated by the harmonic generator 404, to "0". Even if the amplitude adjuster 408 receives a control signal from the harmonic selector 406 indicating each of the harmonic signals do not exist in the masked area, the amplitude adjuster 408 may still adjust the amplitude of each of the harmonic signals in the masked area to "0", as desired. That is, using a method of adjusting the amplitudes of the harmonic signals existing in the masked area to "0", the harmonic signals existing in the masked area, i.e., signals not perceived by the auditory sense, may be excluded from a bass signal enhancement process. According to Equation 1, if the number of harmonic components is a large, the THD value may increase. Thus, by enhancing a bass signal while excluding the harmonic signals found in the masked area, a distortion component of sound quality may be lowered, resulting in an increase in sound quality. Even if the amplitudes of the harmonic signals existing in the masked area are adjusted to "0," according to an embodiment of the present invention, embodiments of the present invention are not necessary limited thereto, and the amplitudes of the harmonic signals existing in the masked area may be adjusted to any value approximately equal to "0".

The synthesizer 410 may receive a signal input through the input terminal IN1, but not passing through the path of the LPF 402. The synthesizer 410 may also receive harmonic signals obtained by adjusting the amplitudes of the harmonic signals existing in the masked area to "0," from among the harmonic signals generated by the harmonic generator 404, in the amplitude adjuster 408. The synthesizer 410 may synthesize the received signals and output the result via an output terminal OUT1.

Figure 7:
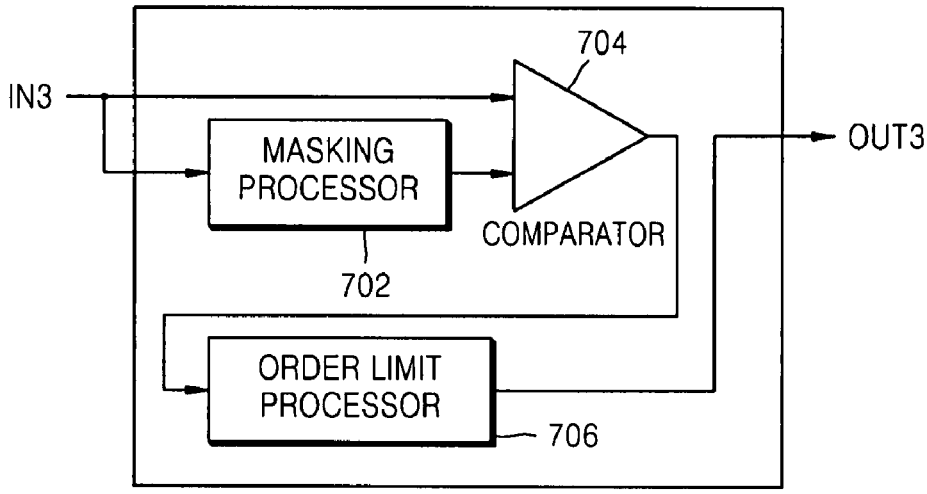
FIG. 7 illustrates a harmonic selector such as of the apparatus for enhancing an acoustic signal illustrated in FIG. 4, according to another embodiment of the present invention.

FIG. 7 illustrates the harmonic selector 406, such as of the apparatus illustrated in FIG. 4, according to another embodiment of the present invention.

Referring to FIG. 7, the harmonic selector 406 may include, for example, a masking processor 702, a comparator 704, and an order limit processor 706.

A process for selecting harmonic signals used to perceive a signal having a fundamental frequency will now be described with reference to FIG. 7. Such a process may be used, for example, by the harmonic selector 406.

The masking processor 702 may receive the harmonic signals generated by the harmonic generator 404 via an input terminal IN3, and may store a masking curve value per frequency, generated based on the input second harmonic signal, in a LUT, for example.

The comparator 704 may receive the masking curve values stored in the masking processor 702 and compare the amplitude of each of the input harmonic signals to a corresponding masking curve value. As a comparison result, if the amplitude of a harmonic signal is greater than the corresponding masking curve value, then the harmonic signal is not masked by the second harmonic signal. The harmonic signal may then be selected as a harmonic signal not existing in the masked area of the second harmonic signal, and therefore may be perceived by the auditory sense according to an auditory property. The comparator 704 may output the harmonic signal selected as not existing in the masked area, to the order limit processor 706, for example.

The order limit processor 706 may only select the harmonic signals satisfying a pre-set THD value from among input harmonic signals. Using Equation 1, a THD value that is calculated using the harmonic signals input to the order limit processor 706 may be calculated for each harmonic order. Thus, if the THD value is pre-set, a harmonic having the lowest order, which exceeds the pre-set THD value, may be calculated using Equation 1. A control signal that is to be used for the bass signal enhancement process may then be generated using only the harmonic signals having an order lower than the order of the calculated harmonic, and the generated control signal may be output via an output terminal OUT3.

Since the harmonic selector 406, according to an embodiment, pre-sets the THD value desired by an audience and performs the bass signal enhancement process using harmonic signals satisfying the pre-set THD value, the audience may hear bass signals having the desired sound quality.

Figure 8:
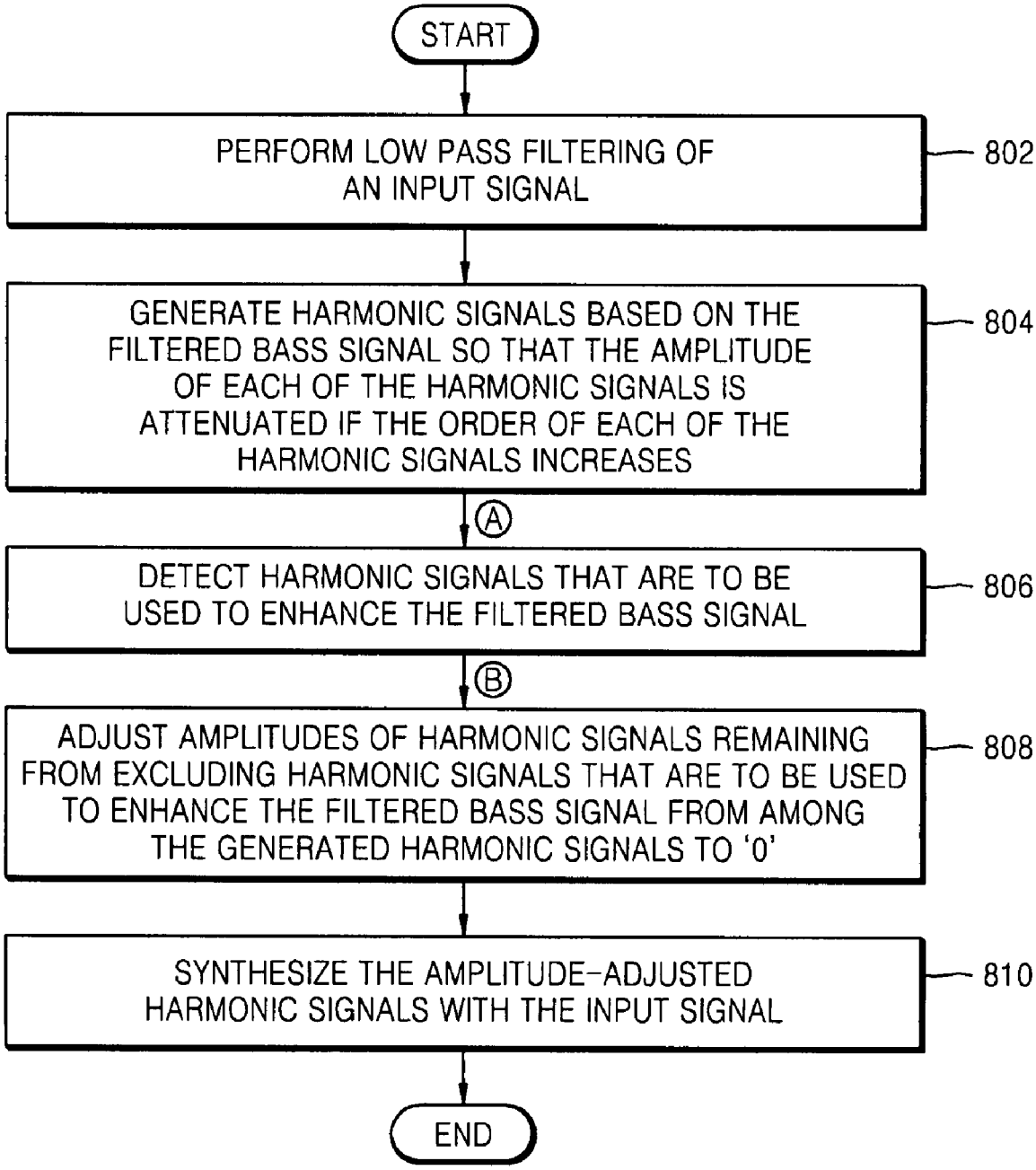
FIG. 8 illustrates a method of enhancing an acoustic signal using an auditory property, according to an embodiment of the present invention.

FIG. 8 illustrates a method of enhancing an acoustic signal using an auditory property, according to an embodiment of the present invention.

Referring to FIG. 8, a bass signal may be filtered from an input signal using, e.g., an LPF in operation 802. By setting a cutoff frequency of the LPF as the minimum reproduction frequency of a speaker, a bass signal having a frequency lower than the minimum reproduction frequency of the speaker may be filtered.

In operation 804, harmonic signals may be generated based on the bass signal filtered in operation 802 so that the amplitude of each of the harmonic signals is attenuated if an order of each of the harmonic signals increases. Each of the harmonic signals may have n times a fundamental frequency (n) is a positive integer equal to or greater than 2). Once the bass signal having a frequency lower than the minimum reproduction frequency of the speaker is filtered using the LPF in operation 802, the harmonic signals having a frequency exceeding the minimum reproduction frequency of the speaker may be generated in operation 804.

In operation 806, the harmonic signals that are to be used to enhance the bass signal filtered in operation 802 may be selected.

Figure 9:
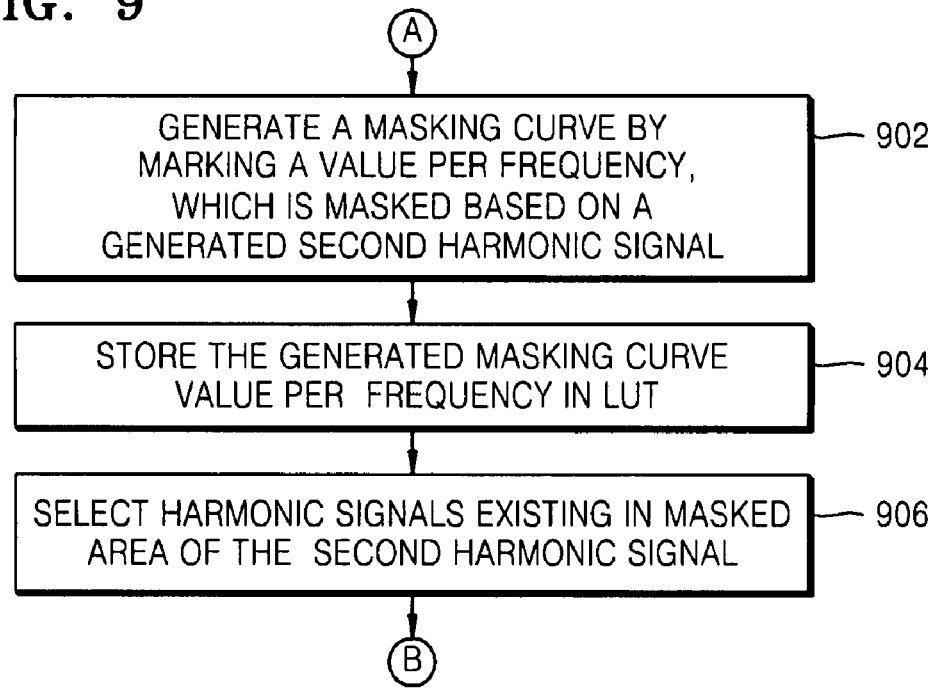
FIG. 9 illustrates a method of selecting harmonic signals used to enhance an acoustic signal, according to an embodiment of the present invention.

FIG. 9 illustrates a method of selecting harmonic signals used to enhance an acoustic signal, according to an embodiment of the present invention.

Referring to FIG. 9, in operation 902, a masking curve may be generated by marking a value for each frequency to be masked, based on the second harmonic signal generated in operation 804. The masking effect, as described, refers to a phenomenon in which a single sound may affect the sound of surrounding frequency components. Thus, a masked value corresponding to each frequency is the maximum amplitude per frequency, which may be affected by the second harmonic signal.

In operation 904, the masking curve value per frequency generated in operation 902 may be stored, for example, in a LUT. Since the masking curve values per frequency are stored in the LUT, a masked value corresponding to a particular frequency can be determined for each of the harmonic signals.

Harmonic signals existing in a masked area of the second harmonic signal may be selected in operation 906. That is, because the harmonic signals existing in the masked area are not perceived by the auditory sense according to an auditory property, in an embodiment, the harmonic signals that are to be used for the bass signal enhancement process may be selected based on whether the harmonic signals are perceived by the auditory sense. In other words, harmonic signals that are unable to be perceived by the auditory sense typically are not selected as harmonic signals to be used for the bass signal enhancement process, while harmonic signals that are perceived by the auditory sense are selected as harmonic signals to be used for the bass signal enhancement process. Since the audience can only perceive harmonics exceeding the masked value, the amplitude of each of the harmonic signals may be compared to the masked value corresponding to a frequency of each of the harmonic signals, and a harmonic signal exceeding the masked value in the comparison result may be selected as a signal perceived by the auditory sense. The harmonic signal perceived by the auditory sense may thus be selected as a harmonic signal to be used to enhance the bass signal.

Figure 10:
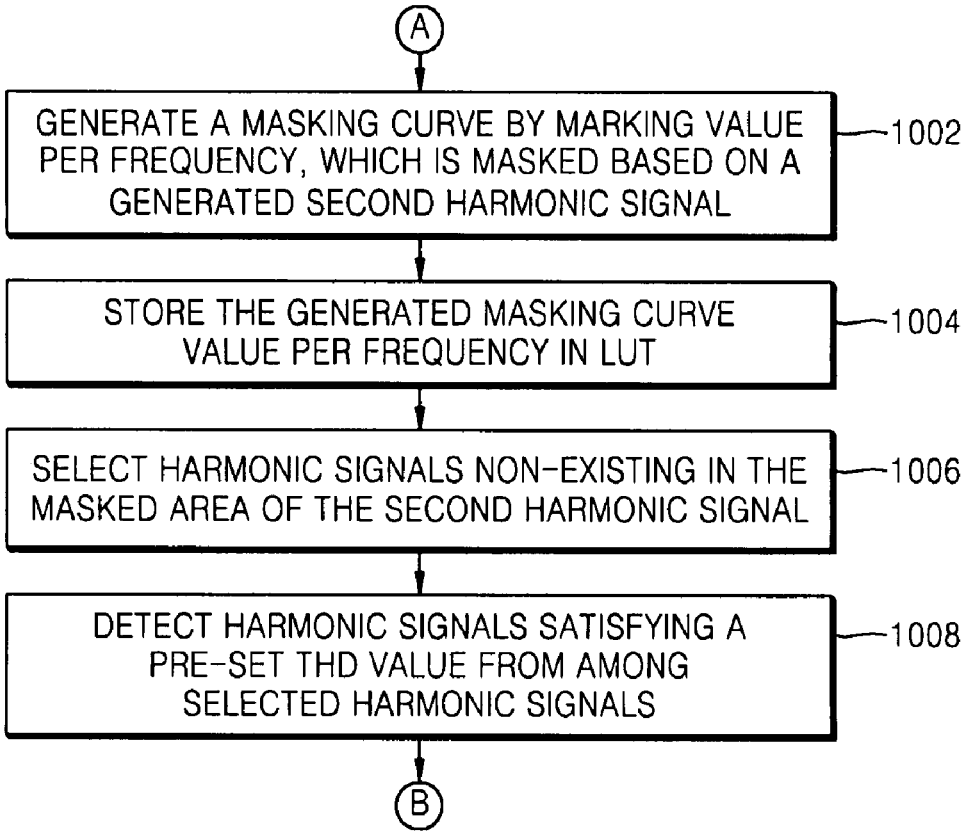
FIG. 10 illustrates a method of selecting harmonic signals used to enhance an acoustic signal, according to an embodiment of the present invention.

FIG. 10 illustrates a method of selecting harmonic signals used to enhance an acoustic signal, according to another embodiment of the present invention.

Referring to FIG. 10, in operation 1002, a masking curve may be generated by marking a value per frequency, which is masked due to the second harmonic signal generated in operation 804.

In operation 1004, the masking curve value per frequency generated in operation 1002 may be stored in a LUT for example. Since the masking curve values are stored in the LUT, a masked value corresponding to a frequency of each of the harmonic signals may be determined.

Harmonic signals that do not exist in a masked area of the second harmonic signal may be selected in operation 1006. That is, since the audience can hear only the harmonic signals that do not exist in the masked area, i.e., harmonics exceeding the masked value, according to an auditory property, the amplitude of each of the harmonic signals may be compared to a masked value corresponding to a frequency of each of the harmonic signals, and a harmonic signal exceeding the masked value in the comparison result may be selected as a harmonic signal to be used to enhance the bass signal.

In operation 1008, only harmonic signals satisfying a pre-set THD value may be selected from among the harmonic signals selected in operation 1006. If the THD value is pre-set, a harmonic having the lowest order, which exceeds the pre-set THD value, may be calculated using Equation 1. Harmonic signals having an order lower than the order of the calculated harmonic may be selected as harmonic signals satisfying the pre-set THD value, and the selected harmonic signals may be determined as the harmonic signals to be used to enhance the bass signal.

Referring back to FIG. 8, in operation 808, the amplitudes of the harmonic signals remaining, after excluding the harmonic signals selected in operation 806 to enhance the bass signal, may be adjusted to "0". Alternatively, the amplitudes of the harmonic signals remaining, after excluding the harmonic signals selected in operation 1008 to enhance the bass signal, are adjusted to "0". As described above, by adjusting the amplitudes of the harmonic signals that are not perceived by the auditory sense to "0", the harmonic signals that are not perceived by the auditory sense are excluded when the bass signal is enhanced. This method is based on the principle that while a signal of a fundamental frequency can be perceived using harmonic signals, if the quantity of harmonics is a, the THD value increases resulting in inferior sound quality. In other words, by representing the signal of the fundamental frequency using only audible harmonic signals while excluding signals that are not perceived by the auditory sense, the sound quality may be improved. In addition, since the bass signal is enhanced using only harmonic signals satisfying a pre-set THD value, the bass signal having a minimum sound quality, as selected by an audience, can be heard.

In operation 810, the harmonic signals whose amplitude are adjusted in operation 808 may be synthesized with the input signal and output.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code may be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as carrier waves, as well as through the Internet, for example. Thus, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

As described herein, according to one or more embodiments of the present invention, by generating a plurality of harmonic signals based on a predetermined acoustic signal frequency, selecting harmonic signals that exist in an area masked by a predetermined harmonic signal from among the generated harmonic signals, and outputting harmonic signals remaining after excluding the selected harmonic signals from the generated harmonic signals, a bass signal of improved sound quality having a low THD value may be heard without changing the structure and size of a micro speaker.

In addition a plurality of harmonic signals may be generated based on a predetermined acoustic signal frequency, and harmonic signals that do not exist in an area masked by a predetermined harmonic signal may be selected from among the generated harmonic signals. If a THD value calculated while increasing an order of the selected harmonic signals exceeds a predetermined THD value, the minimum order of harmonic signals whose THD value exceeds the predetermined THD value may be determined as a limited harmonic order, and only harmonic signals whose order is lower than the determined minimum order may be output among the selected harmonic signals, resulting in a bass signal having a minimum sound quality, as selected by an audience without changing the structure and size of a micro speaker.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of enhancing an acoustic signal to be input to a speaker, the method comprising:

filtering, from the signal to be input to the speaker, a predetermined audio signal having a frequency less than or equal to a minimum reproduction frequency of the speaker;

representing the predetermined audio signal as a plurality of harmonic signals that are generated based on the frequency of the predetermined audio signal;

selecting, by way of a processor, one predetermined harmonic signal, from among the generated plurality of harmonic signals, the one predetermined harmonic signal having a greatest amplitude from among the generated plurality of harmonic signals;

selecting, by way of a processor, only those harmonic signals from among the generated plurality of harmonic signals that exist in an area masked by the one predetermined harmonic signal; and outputting, to the speaker, harmonic signals remaining after excluding the selected harmonic signals from the generated plurality of harmonic signals to decrease a total harmonic distortion of the harmonic signals output to the speaker.

2. The method of claim 1, wherein each of the plurality of generated harmonic signals has a frequency that is equal to or greater than the minimum reproduction frequency of the speaker.

3. The method of claim 1, wherein the generating of the plurality of harmonic signals comprises generating the plurality of harmonic signals by modulating amplitudes of the plurality of harmonic signals so that the amplitudes of the plurality of harmonic signals are attenuated proportionally to their harmonic order, with respect to a frequency of the predetermined audio signal.

4. A method of enhancing an acoustic signal, the method comprising:

generating a plurality of harmonic signals based on a predetermined audio signal;

selecting, by way of a processor, harmonic signals that do not exist in an area masked by a predetermined harmonic signal, from among the generated plurality of harmonic signals;

upon a Total Harmonic Distortion (THD) value, calculated while increasing an order of the selected harmonic signals, exceeding a predetermined THD value, determining a minimum order of harmonic signals, whose THD value exceeds the predetermined THD value, as a limited harmonic order; and outputting harmonic signals whose order is lower than the determined limited harmonic order from among the selected harmonic signals.

5. The method of claim 4, wherein the predetermined harmonic signal is a harmonic signal having a greatest amplitude from among the generated plurality of harmonic signals.

6. The method of claim 4, wherein the predetermined audio signal is generated by filtering a signal having a frequency less than or equal to a minimum reproduction frequency of a speaker outputting the harmonic signals.

7. The method of claim 4, wherein the harmonic signals each have a frequency greater than a minimum reproduction frequency of a speaker outputting the harmonic signals.

8. The method of claim 4, wherein the generating of the plurality of harmonic signals comprises generating the plurality of harmonic signals by modulating amplitudes of the harmonic signals so that the amplitudes of the harmonic signals are attenuated proportionally to their harmonic order based on the frequency of the predetermined acoustic signal.

9. A non-transitory computer readable storage medium encoded with computer readable code to control at least one processing element to implement the method of any one of claims 1 through 8.

10. An apparatus for enhancing a bass signal to be input to a speaker using an auditory property, the apparatus comprising:

a low-pass filter to filter, from the signal to be input to the speaker, a predetermined audio signal having a frequency less than or equal to a minimum reproduction frequency of the speaker;

a harmonic generator to represent the predetermined audio signal as a plurality of harmonic signals that are generated based on the frequency of the predetermined audio signal filtered by the low-pass filter;

a harmonic selector to select, by way of a processor, one predetermined harmonic signal, from among the generated plurality of harmonic signals, the one predetermined harmonic signal having a greatest amplitude from among the generated plurality of harmonic signals and to select, by way of a processor, only those harmonic signals from among the generated plurality of harmonic signals that are not masked by the one predetermined harmonic signal; and an output unit to output, to the speaker, harmonic signals selected by the harmonic selector to decrease a total harmonic distortion of the harmonic signals output to the speaker.

11. The apparatus of claim 10, wherein the harmonic selector comprises:

a storage unit to store a masked value per frequency with respect to the harmonic signal having the greatest amplitude from among the generated plurality of harmonic signals;

a comparator to respectively compare amplitudes of the generated plurality of harmonic signals to the masked values stored in the storage unit for each frequency, wherein as a comparison result of the comparator, harmonic signals, of the plurality of harmonic signals, respectively exceeding masked values stored in the storage unit are selected as harmonic signals that do not exist in an area masked by the predetermined harmonic signal.

12. The apparatus of claim 11, wherein the harmonic selector further comprises a harmonic order determiner, in which if a Total Harmonic Distortion (THD) value calculated while an order of the harmonic signals respectively exceeding masked values stored in the storage unit increases as the comparison result exceeds a predetermined THD value, determines the minimum order of harmonic signals whose THD value exceeds the predetermined THD value as a limited harmonic order, wherein as the comparison result of the comparator, harmonic signals of an order lower than the order determined by the harmonic order determiner from among harmonic signals respectively exceeding the masked values stored in the storage unit are selected as the harmonic signals non-existing in the area masked by the harmonic signal having the greatest amplitude from among the generated plurality of harmonic signals.

13. The apparatus of claim 10, wherein the harmonic generator generates the plurality of harmonic signals such that each of the plurality of generated harmonic signals has a frequency that is equal to or greater than the minimum reproduction frequency of the speaker.

14. The apparatus of claim 10, wherein the harmonic generator generates the plurality of harmonic signals by modulating amplitudes of the harmonic signals so that the amplitudes of the harmonic signals are attenuated proportionally to their harmonic order based on a frequency of a predetermined signal filtered by the LPF.

15. An apparatus for enhancing an acoustic signal to be input to a speaker, the apparatus comprising:

a low-pass filter to filter, from the signal to be input to the speaker, a predetermined audio signal having a frequency less than or equal to a minimum reproduction frequency of the speaker;

a harmonic generator to represent the predetermined audio signal as a plurality of harmonic signals that are generated based on the frequency of the predetermined audio signal;

a harmonic selector to select, by way of a processor, one predetermined harmonic signal, from among the generated plurality of harmonic signals, the one predetermined harmonic signal having a greatest amplitude from among the generated plurality of harmonic signals and to select, by way of a processor, only those harmonic signals from among the generated plurality of harmonic signals masked by the one predetermined harmonic signal;

an amplitude adjuster to adjust amplitudes of harmonic signals selected by the harmonic selector to "0;" and an output unit to output, to the speaker, harmonic signals excluding those harmonic signals selected by the harmonic selector to decrease a total harmonic distortion of the harmonic signals output to the speaker.

16. The apparatus of claim 15, wherein the harmonic selector comprises:

a storage unit to store a masked value per frequency with respect to the harmonic signal having the greatest amplitude from among the generated harmonic signals;

a comparator to respectively compare generated plurality of harmonic signals to the masked values stored in the storage unit for each frequency, wherein as a comparison result of the comparator, harmonic signals, of the plurality of harmonic signals, respectively not exceeding masked values stored in the storage unit are selected as harmonic signals existing in an area masked by the predetermined harmonic signal.

17. The apparatus of claim 15, wherein the harmonic generator generates harmonic signals such that each of the generated harmonic signals has a frequency that is equal to or greater than the minimum reproduction frequency of the speaker.

18. The apparatus of claim 15, wherein the harmonic generator generates harmonic signals by modulating amplitudes of the harmonic signals so that the amplitudes of the harmonic signals are attenuated proportionally to their harmonic order based on a frequency of a predetermined signal filtered by the LPF.

19. The apparatus of claim 15, further comprising an output unit to output the plurality of harmonic signals generated by the harmonic generator.

20. A method of representing an audio signal to be input to a speaker using a plurality of harmonics generated from the audio signal, the method comprising:

selecting, by way of a processor, one predetermined harmonic signal, from among the generated plurality of harmonic signals, the one predetermined harmonic signal having a greatest amplitude from among the generated plurality of harmonic signals;

generating a masking curve based only on the one predetermined harmonic signal;

selecting, by way of a processor, only unmasked harmonics, based on the generated masking curve, to represent the audio signal; and outputting the unmasked harmonics to the speaker while excluding all other harmonic signals from the generated plurality of harmonic signals to decrease a total harmonic distortion of the harmonic signals output to the speaker.

21. The method of claim 20, wherein the selected harmonics each have a frequency greater than a minimum reproduction frequency of a speaker outputting the selected harmonics.

22. A non-transitory computer readable storage medium encoded with computer readable code to control at least one processing element to implement the method of claim 20.

* * * * *